US008607808B1

(12) United States Patent
You

(10) Patent No.: US 8,607,808 B1
(45) Date of Patent: Dec. 17, 2013

(54) LIGHT WINDPROOF UMBRELLA

(76) Inventor: Ching-Chuan You, Taipei (TW)

( * ) Notice: Subject to any disclaimer, the term of this patent is extended or adjusted under 35 U.S.C. 154(b) by 0 days.

(21) Appl. No.: 13/537,083

(22) Filed: Jun. 29, 2012

(51) Int. Cl.
*A45B 25/22* (2006.01)

(52) U.S. Cl.
USPC ..... 135/29; 135/25.33; 135/27; 135/32

(58) Field of Classification Search
USPC ..... 135/15.1, 27, 29–32, 33.2, 33.7, 25.33
See application file for complete search history.

(56) References Cited

U.S. PATENT DOCUMENTS

| | | | | |
|---|---|---|---|---|
| 1,369,996 | A * | 3/1921 | Westbeld | 135/27 |
| 1,743,043 | A * | 1/1930 | McLean | 135/27 |
| 2,522,645 | A * | 9/1950 | Senna | 135/27 |
| 5,372,155 | A * | 12/1994 | You | 135/29 |
| 6,167,894 | B1 * | 1/2001 | Lin | 135/15.1 |
| 6,216,712 | B1 * | 4/2001 | Lin et al. | 135/31 |
| 6,276,380 | B1 * | 8/2001 | Okuda | 135/33.7 |
| 6,502,592 | B2 * | 1/2003 | Chen | 135/33.7 |
| 6,758,228 | B1 * | 7/2004 | You | 135/29 |
| 6,789,556 | B2 * | 9/2004 | You | 135/31 |
| 7,509,965 | B2 * | 3/2009 | Wu | 135/28 |
| 7,980,262 | B1 | 7/2011 | You | |
| 2003/0079765 | A1 * | 5/2003 | Lin et al. | 135/16 |
| 2003/0178050 | A1 * | 9/2003 | Wu | 135/32 |
| 2007/0137682 | A1 * | 6/2007 | Wu | 135/33.7 |

* cited by examiner

*Primary Examiner* — Winnie Yip

(57) ABSTRACT

A light windproof umbrella is provided with a center post including a top ferrule, an upper grommet, an intermediate sliding ring, and a sliding runner under the sliding ring; ribs each having one end pivotably secured to the grommet and the other end being open; main joints each formed at a portion of the rib proximate to the other end of the rib; auxiliary joints each formed at a portion of the rib between the main joint and the grommet; stretchers each having one end pivotably secured to the sliding ring and the other end moveably secured to the rib; struts each having one end pivotably secured to the sliding runner and the other end pivotably secured to the auxiliary joint; a lower canopy; and an upper canopy in a partial covering relationship to the lower canopy.

1 Claim, 7 Drawing Sheets

LIGHT WINDPROOF UMBRELLA

BACKGROUND OF THE INVENTION

1. Field of the Invention

The invention relates to windproof umbrellas and more particularly to a light windproof umbrella.

2. Description of Related Art

Umbrellas are widely used personal articles. It is often that wind will catch an umbrella user unaware and exert a force against an inner surface of a canopy of the umbrella so as to cause the canopy to invert from its normal operable position to an upward convex position.

Windproof umbrellas are thus developed for windy weather. For example, U.S. Pat. No. 7,980,262 discloses a windproof umbrella comprising a center post 10 comprising an upper grommet 11, an intermediate fixed ring 12, and a lower sliding runner 13; a plurality of ribs 20 each having one end 21 pivotably secured to the grommet 11 and another open end 22; a plurality of main joints 51 each formed at a portion of the rib 20 proximate to the other end 22; a plurality of stretchers 30 each having one end 31 pivotably secured to the ring 12 and the other end 32 slidably and pivotally secured to the main joint 51; a plurality of auxiliary joints 61 each formed at a portion of the stretcher 30; and a plurality of struts 40 each having an one end 41 pivotably secured to the runner 13 and another end 42 moveably secured to the auxiliary joint 61; a lower canopy 70 fastened in covering relationship on the ribs 20; and an upper canopy 80 having a center secured to the grommet 11 and an outer peripheral edge positioned over a portion of the lower canopy 70 in covering relationship to all of the main joints 51, wherein wind caught beneath the canopies 70, 80 applies pressure to the canopies 70, 80 to cause a portion of the upper canopy 80 to lift away from a portion of the lower canopy 70 to form a plurality pairs of communicating inner and outer vent holes 71, 81 with the other ends 32 of the stretchers 30 sliding away from the center post 10, each pair of the inner and outer vent holes 71, 81 being defined by the portions of the upper and lower canopies 70, 80, the adjacent ribs 20, and the adjacent main joints 51.

However, a number of drawbacks have been found in the prior art windproof umbrella. In detail, diameters of the stretchers 30, the struts 40 and the ribs 20 are required to be equal so that the umbrella can withstand the force exerted thereon by strong wind. This inevitably can increase the weight of the umbrella greatly, resulting in a decrease of portability of the umbrella. Further, a person has to exert a great force to grasp the center post 10 in windy weather. This can quickly exhaust the strength of the person holding the umbrella. Thus, the need for improvement still exists.

SUMMARY OF THE INVENTION

It is therefore one object of the invention to provide a windproof umbrella comprising a center post comprising a top ferrule, an upper grommet, an intermediate sliding ring under the upper grommet, and a sliding runner under the intermediate sliding ring; a plurality of ribs each having one end pivotably secured to the upper grommet and the other end being open; a plurality of main joints each formed at a portion of the rib proximate to the other end of the rib; a plurality of auxiliary joints each formed at a portion of the rib between the main joint and the upper grommet; a plurality of stretchers each having one end pivotably secured to the intermediate sliding ring and the other end moveably secured to the rib; a plurality of struts each having one end pivotably secured to the sliding runner and the other end pivotably secured to the auxiliary joint; a lower canopy fastened in covering relationship to the main joints and portions of the ribs wherein an inner closed edge of the lower canopy is secured to points of the ribs proximate to the auxiliary joints and not covering the auxiliary joints, and an outer peripheral edge thereof is secured to the other ends of the ribs; an upper canopy having a center secured to the upper grommet and an outer peripheral edge positioned over a portion of the inner peripheral edge of the lower canopy and being in covering relationship to the auxiliary joints, wherein wind caught beneath the lower and upper canopies applies pressure to the lower and upper canopies to cause a portion of the upper canopy to lift away from a corresponding portion of the lower canopy to form a plurality of vent holes, slide the other ends of the stretchers toward a direction away from the center post, and slide the intermediate sliding ring downward along the center post.

The above and other objects, features and advantages of the invention will become apparent from the following detailed description taken with the accompanying drawings.

DETAILED DESCRIPTION OF THE INVENTION

Figure 1:
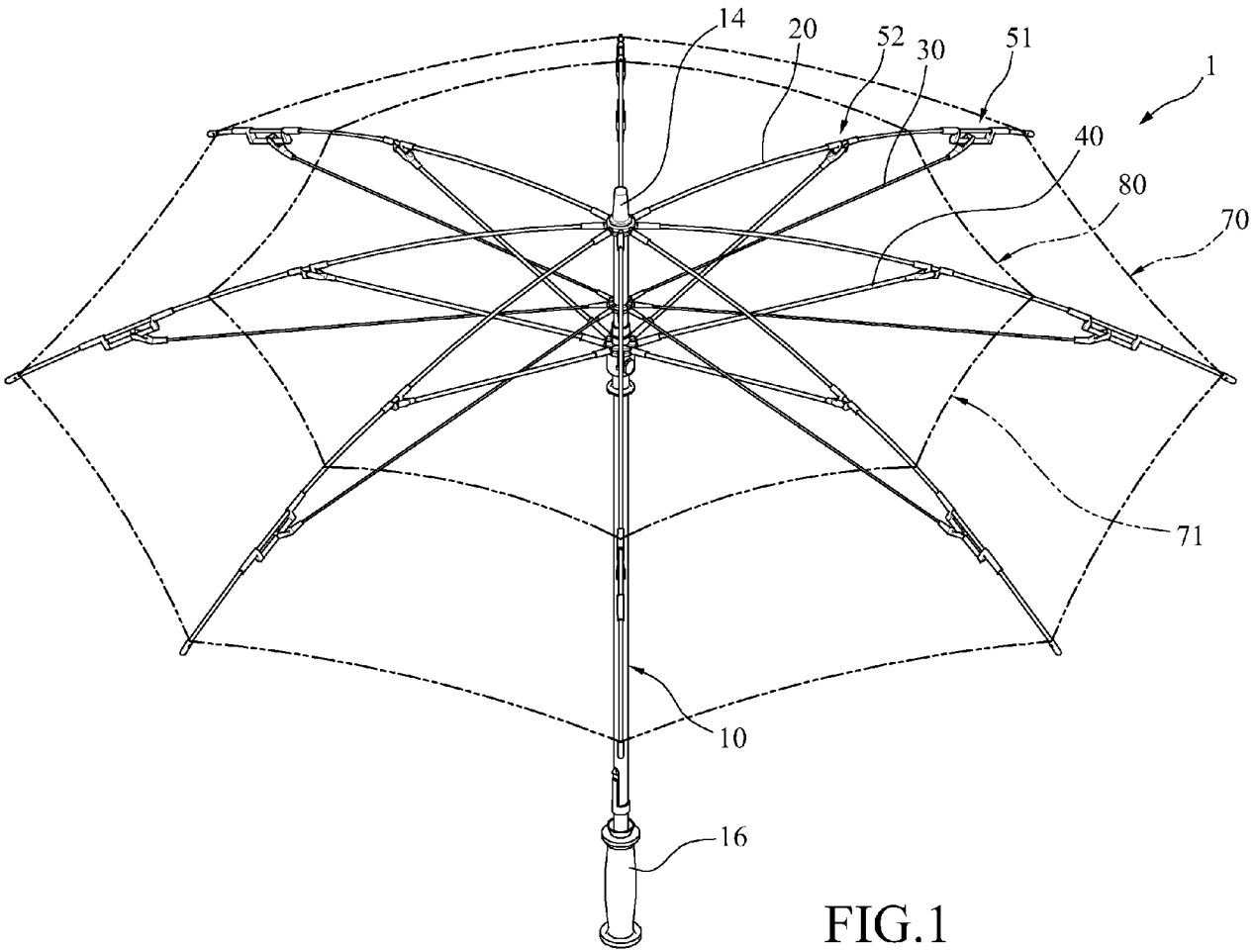
FIG. 1 is a perspective view of the frame of a light windproof umbrella according to the invention, the umbrella being open and the canopies being shown in phantoms.
Figure 2:
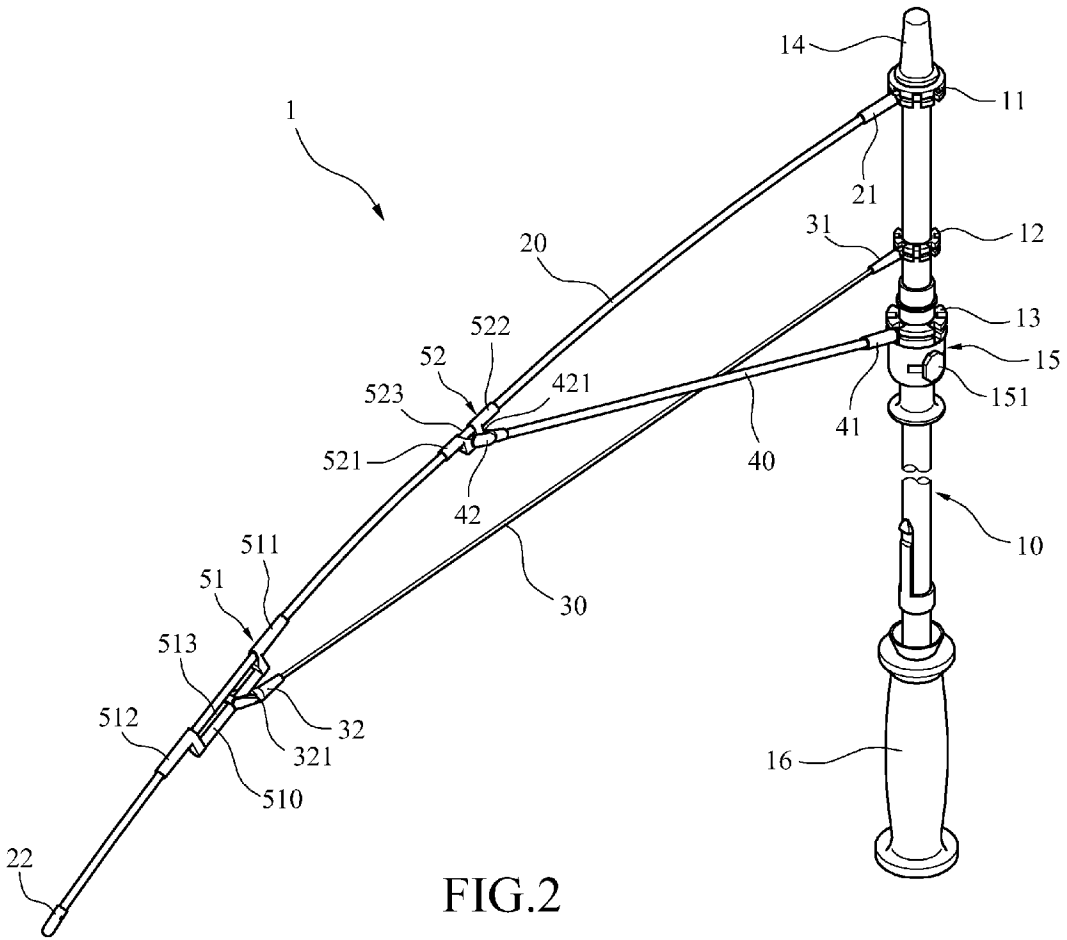
FIG. 2 is a fragmentary view of the umbrella.
Figure 3:
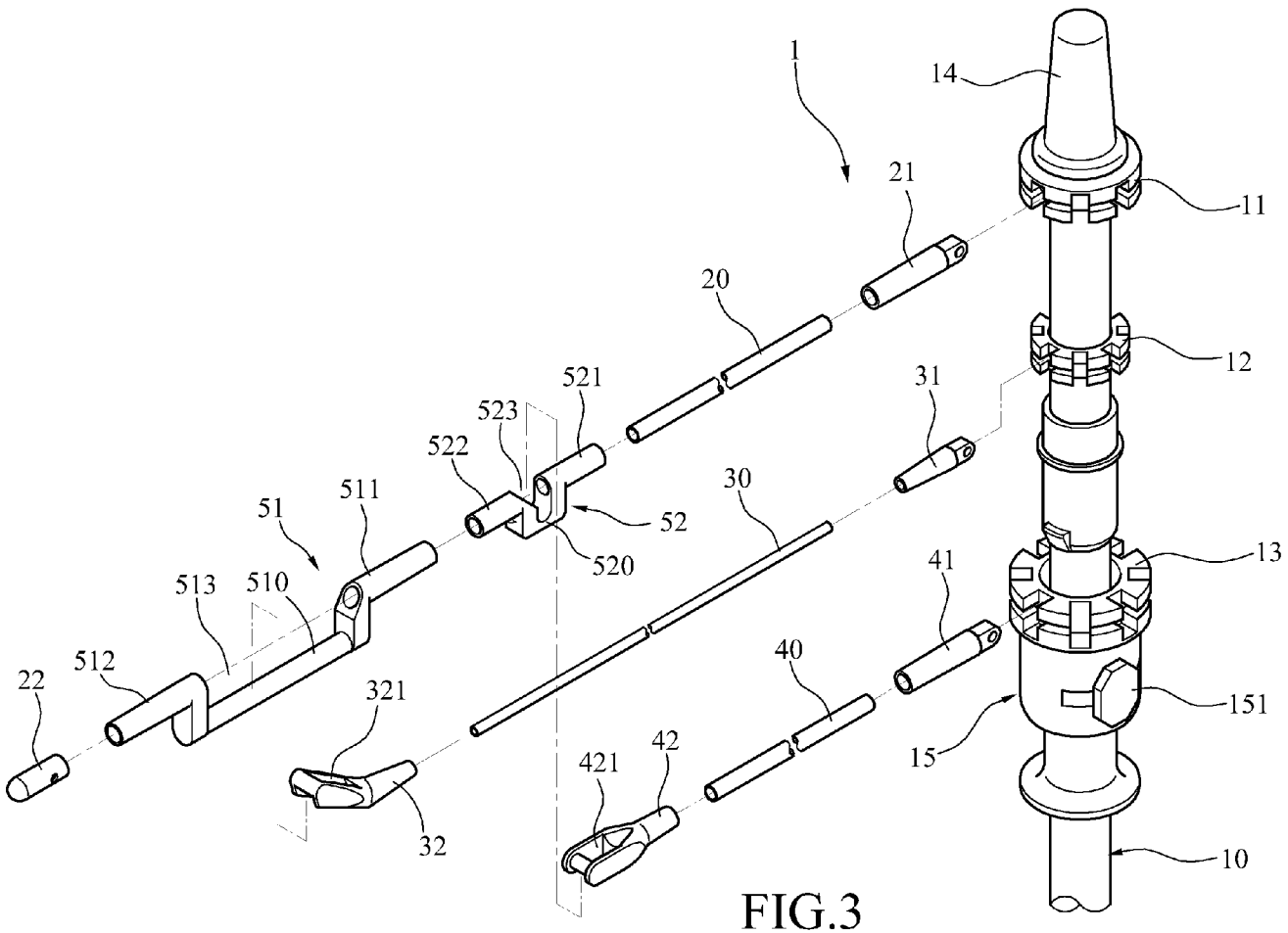
FIG. 3 is an exploded view of FIG. 2.
Figure 4:
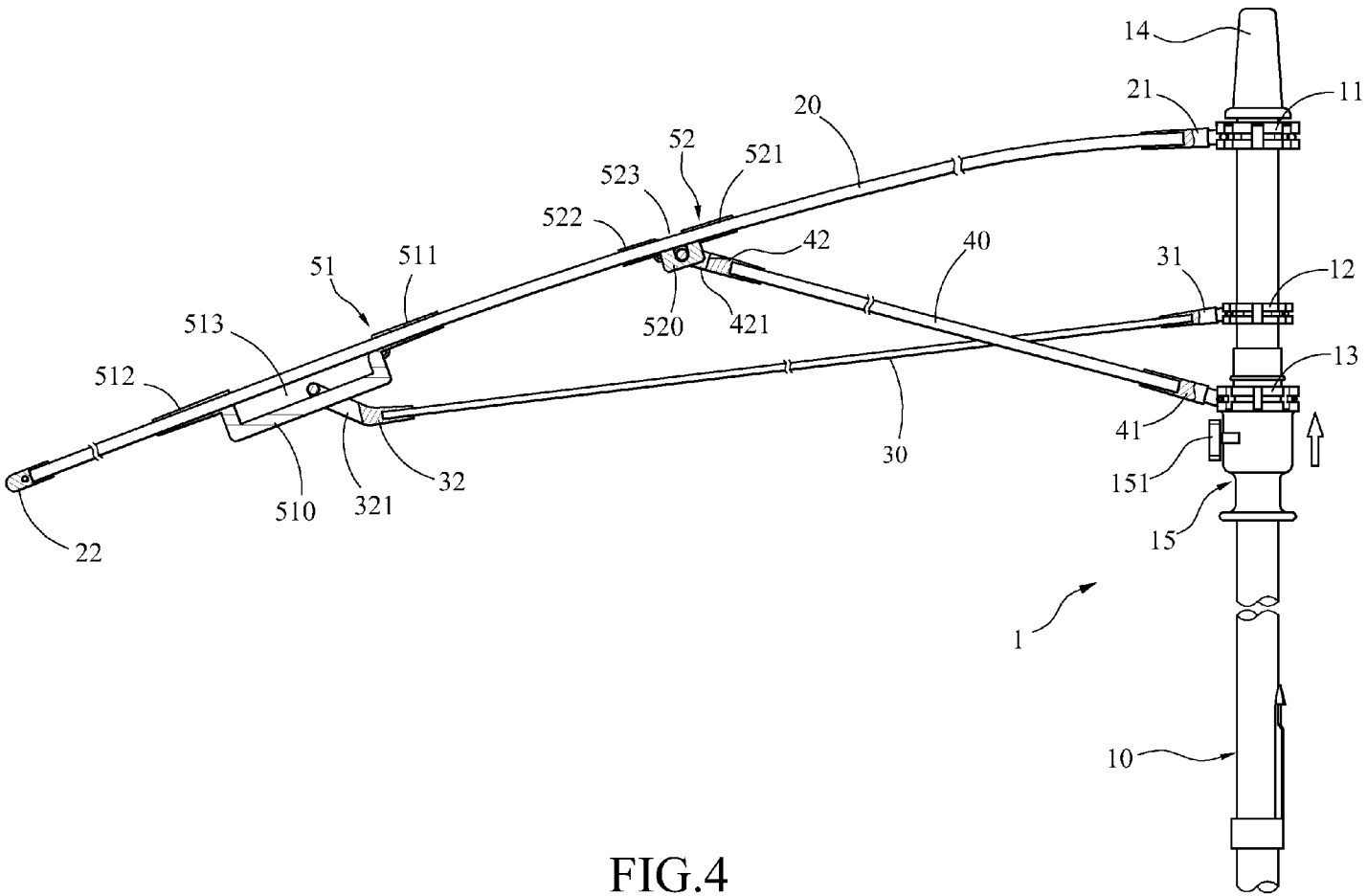
FIG. 4 is a side elevation in part section of FIG. 2 showing the umbrella frame being pushed upward to open.
Figure 5:
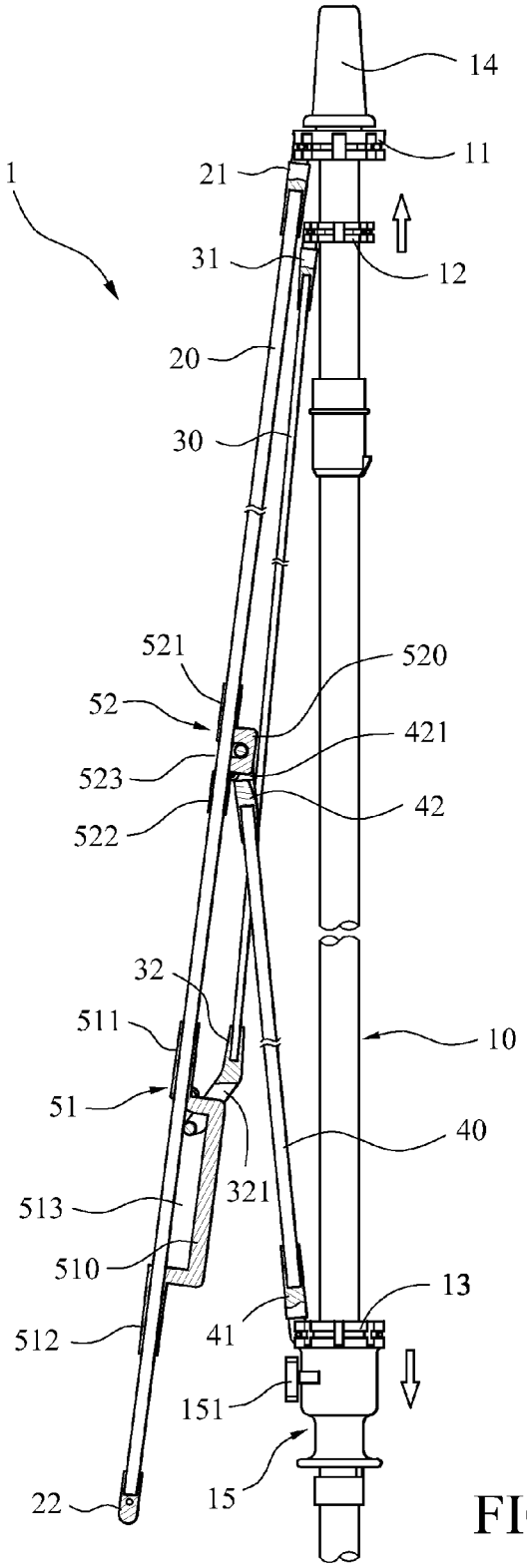
FIG. 5 is a view similar to FIG. 4 showing the umbrella frame being pushed downward to close.

Referring to FIGS. 1 to 7, a light windproof umbrella 1 in accordance with the invention comprises the following components as discussed in detail below.

A center post 10 comprises a top ferrule 14, an upper grommet 11, an intermediate sliding ring 12 under the grommet 11, a lower sliding runner 13 under the ring 12, and a lock 15 adjacent to the sliding member 13 from below, the lock 15 including an exposed tab 151 adapted to be pressed to unlock the lock 15 for closing the umbrella 1. A plurality of ribs 20 each have one end 21 pivotably secured to the grommet 11 and the other open end 22. A plurality of main joints 51 each are formed at a portion of the rib 20 proximate to the other end 22. The main joint 51 is shaped as a U and comprises a first tubular end 511 with the rib 20 passing through, a second tubular end 512 also with the rib 20 passing through, a U-shaped bar 510 interconnecting the first and second tubular ends 511, 512, and a wide channel 513 defined by the bar 510, the first and second tubular ends 511, 512, and a portion of the rib 20 between the first and second tubular ends 511, 512.

A plurality of stretchers 30 each have one end 31 pivotably secured to the ring 12 and the other end 32 shaped as a closed loop and put on the bar 510 of the main joint 51 to be moveably restrained in the channel 513 with a large moveable extent. A plurality of auxiliary joints 52 each are formed at an intermediate portion of the rib 20 with the increased support of one of a plurality of struts 40 to reinforce the whole strength of the windproof umbrella 1 of the invention. The auxiliary joint 52 is shaped as a U and comprises a first tubular end 521 with the rib 20 passing through, a second tubular end 522 with the rib 20 passing through, a U-shaped bar 520 interconnecting the first and second tubular ends 521, 522, and a narrow tunnel 523 defined by the bar 520, the first and second tubular ends 521, 522, and a portion of the rib 20 between the first and second tubular ends 521, 522. The plurality of struts 40 each have one end 41 pivotably secured to the runner 13 and the other end 42 shaped as a closed loop and put on the bar 520 to be pivotably restrained in the tunnel 523.

Preferably, the struts 40 and the rib 20 are formed of carbon-fiber-reinforced polymer (CFRP).

Still preferably, the stretchers 30 are formed of CFRP. A diameter of the stretcher 30 is less than that of the rib 20 and the struts 40, such as one-half of the diameter of the rib 20 and the struts 40. The elongated stretchers 30 thus have the advantages of being light and strong.

A lower canopy 70 is fastened in covering relationship to the main joints 51 and portions of the ribs 20. In detail, an inner closed edge of the lower canopy 70 is secured to points the ribs 20 proximate to but not covering the auxiliary joints 52 and an outer peripheral edge thereof is secured to the other ends 22 of the ribs 20.

An upper canopy 80 has its center secured to the grommet 11 and its outer peripheral edge positioned over a portion of inner peripheral edge of the lower canopy 70 and being in covering relationship to the auxiliary joints 52. That is, the main joints 51 are covered by the upper canopy 80 so as to form a plurality of vent holes 71 each being defined by the lower and upper canopies 70, 80 and portions of any two adjacent ribs 20 proximate to the main joints 51.

Figure 6:
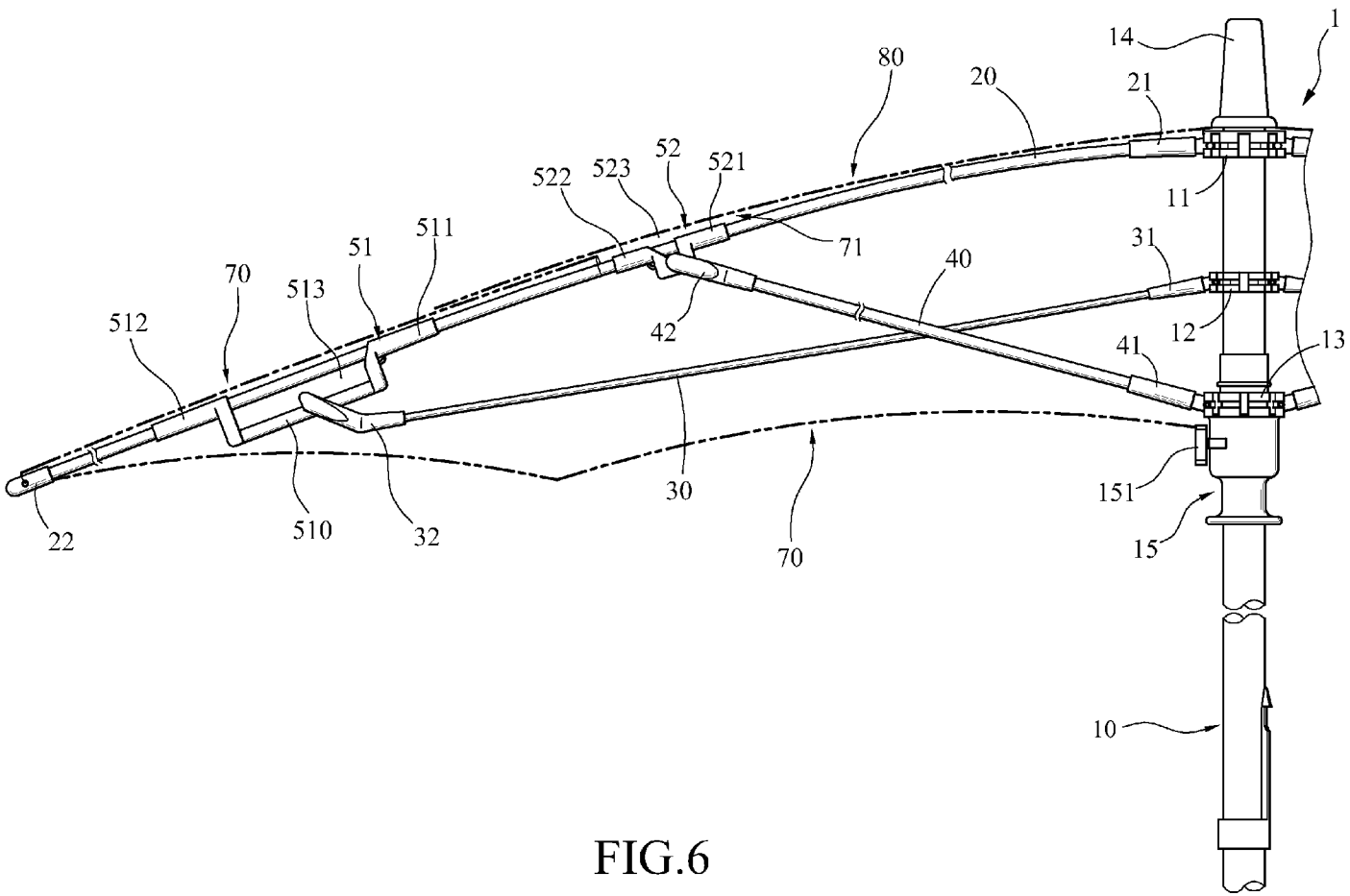
FIG. 6 is a fragmentary view of FIG. 4 showing a state of the umbrella prior to wind blowing from below.
Figure 7:
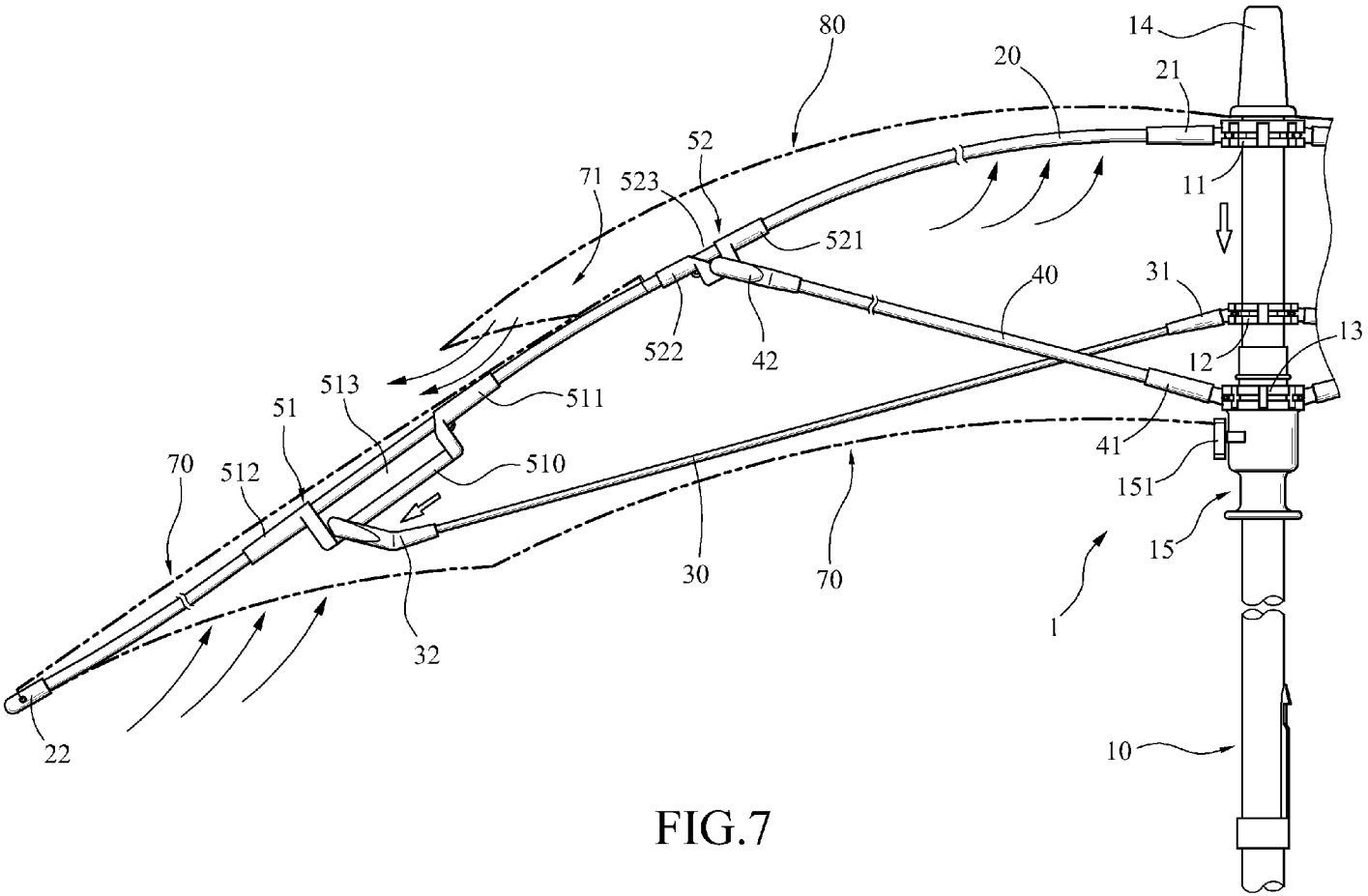
FIG. 7 is a view similar to FIG. 6 showing a state of the umbrella in response to strong wind blowing from below.

As shown in FIGS. 6 and 7, during rainy, windy weather, wind (as indicated by a plurality of groups of curved arrows of FIG. 7) caught beneath the canopies 70, 80 of the umbrella 1 may apply pressure to the undersides of the canopies 70, 80. This pressure causes each substantially triangular portion of the upper canopy 80 proximate to the main joints 51 to lift away from the portion of the lower canopy 70 proximate to the main joints 51. As such, a plurality of vent holes 71 are formed. Also, the other ends 32 of the stretchers 30 slide toward the outer direction as indicated by one hollow arrow proximate to the bar 510 and the sliding ring 12 slides downward along the center post 10 as indicated by the other hollow arrow between the sliding ring 12 and the grommet 11 in FIG. 6. Therefore, wind passes through the vent holes 71 for escape from the umbrella 1. It is contemplated by the invention that any excessive wind will not invert the umbrella 1 due to the above descriptions and this is the characteristics of the invention.

During rainy, windy weather, wind caught beneath the canopies 70, 80 of the umbrella 1 may apply pressure to the undersides of the canopies 70, 80. This pressure causes each portion of the upper canopy 80 proximate to the main joints 51 to lift away from each corresponding portion of the lower canopy 70. As discussed above, the other ends 32 of the stretchers 30 are freely and moveably restrained by the main joints 51 in a larger range, the other ends 42 of the struts 40 are pivotably secured to the auxiliary joints 52, and one ends 41 of the struts 40 are pivotably secured to the runner 13. The ribs 20 may flexibly bend upward to cause the other ends 32 of the stretchers 30 to slide toward the outer direction (as indicated by arrow in FIG. 7). Also, one ends 31 of the stretchers 30 may slide downward along the center post 10 to cause the other ends 32 thereof restrained in the channel 513 to slide toward the outer direction. Further, the struts 40 may have both ends 41, 42 pivoting about the auxiliary joints 52 and the runner 13. The flexible nature of the ribs 20 in cooperation with the moveable ends 32 of the stretchers 30 at the main joints 51 and the sliding ends 31 of the stretchers 30, and the pivotal connections of the struts 40 to both the auxiliary joints 52 and the runner 13 can prevent the umbrella 1 from being inverted when strong wind blows.

The moveably restrained other ends 32 of the stretchers 30 in the main joints 51 is the first force connecting the stretchers 30 to the ribs 20 and this can achieve an increased flexible adjustment of the ribs 20. Further, the channels 513 of the main joints 51 can provide a large extent of the flexible deformation of the ribs 20 and thus increase the resistance of the ribs 20 against excessive wind. The above characteristics of the stretchers 30 are carried out by cooperating with the sliding ends 31 thereof. The pivotal fastening of the other ends 42 of the struts 40 at the auxiliary joints 52 is the second force connecting the struts 40 to the ribs 20. The ribs 20 may bend upward to pull the overlap of the canopies 70, 80 away from each other to form a plurality of vent holes 71. Advantageously, excessive wind may escape via the vent holes 71. This is the flexible deformation characteristic of the umbrella 1 for resisting inversion from excessive wind. The umbrella 1 may return to its original shape when excessive wind is successfully vented. This wind escape characteristic of the windproof umbrella 1 with an aid of the reinforced configuration in a larger movable range of the main joints 51 and the auxiliary joints 52, together with the first force connecting the stretchers 30 to the ribs 20 and the second force connecting the struts 40 to the ribs 20, is unique and novel and can be effectively resistant to inversion from the excessive wind.

While the invention has been described in terms of preferred embodiments, those skilled in the art will recognize that the invention can be practiced with modifications within the spirit and scope of the appended claims.

What is claimed is:

1. A windproof umbrella comprising:

a center post (10) comprising a top ferrule (14), an upper grommet (11), an intermediate sliding ring (12) under the upper grommet (11), and a sliding runner (13) under the intermediate sliding ring (12);

a plurality of ribs (20) each having one end (21) pivotably secured to the upper grommet (11) and the other end (22) being open;

a plurality of main joints (51) each formed at a portion of the rib (20) proximate to the other end (22) of the rib (20);

a plurality of auxiliary joints (52) each formed at a portion of the rib (20) between the main joint (51) and the upper grommet (11);

a plurality of stretchers (30) each having one end (31) pivotably secured to the intermediate sliding ring (12) and the other end (32) moveably secured to the rib (20);

a plurality of struts (40) each having one end (41) pivotably secured to the sliding runner (13) and the other end (42) pivotably secured to the auxiliary joint (52);

a lower canopy (70) fastened in covering relationship to the main joints (51) and portions of the ribs (20) wherein an inner closed edge of the lower canopy (70) is secured to points of the ribs (20) proximate to the auxiliary joints (52) and not covering the auxiliary joints (52), and an outer peripheral edge thereof is secured to the other ends (22) of the ribs (20); and an upper canopy (80) having a center secured to the upper grommet (11) and an outer peripheral edge positioned over a portion of the inner peripheral edge of the lower canopy (70) and being in covering relationship to the auxiliary joints (52), wherein each main joint (51) comprises a first tubular end (511) with the rib (20) passing through, a second tubular end (512) with the rib (20) passing through, a U-shaped bar (510) interconnecting the first and second tubular ends (511, 512), and a channel (513) defined by the U-shaped bar (510), the first and second tubular ends (511, 512), and a portion of the rib (20) between the first and second tubular ends (511, 512) so that the other end (32) of each stretcher (30) is moveably restrained in the channel (513) with its closed loop (321);

wherein each auxiliary joint (52) comprises a first tubular end (521) with the rib (20) passing through, a second tubular end (522) with the rib (20) passing through, a U-shaped bar (520) interconnecting the first and second tubular ends (521, 522), and a tunnel (523) defined by the U-shaped bar (520), the first and second tubular ends (521, 522), and a portion of the rib (20) between the first and second tubular ends (521, 522) so that the other end (42) of each strut (40) is pivotably fastened in the tunnel (523) with its closed loop (421); and wherein wind caught beneath the lower and upper canopies (70, 80) applies pressure to the lower and upper canopies (70, 80) to cause a portion of the upper canopy (80) to lift away from a corresponding portion of the lower canopy (70) to form a plurality of vent holes (71), slide the other ends (32) of the stretchers (30) toward a direction away from the center post (10), and slide the intermediate sliding ring (12) downward along the center post (10).

* * * * *